US005215172A

United States Patent [19]

Stevenson

[11] Patent Number: 5,215,172

[45] Date of Patent: Jun. 1, 1993

[54] PORTABLE INFANT CARE PLATFORM

[76] Inventor: Anthony B. Stevenson, 4624 Lexington Crossing, #363, Sacramento, Calif. 95842

[21] Appl. No.: 746,744

[22] Filed: Aug. 19, 1991

[51] Int. Cl.[5] ..... A45C 9/00; A45C 13/26

[52] U.S. Cl. ..... 190/2; 190/1; 190/901

[58] Field of Search ..... 190/1, 2, 13 C, 107, 190/111, 112, 901; 5/417, 419

[56] References Cited

U.S. PATENT DOCUMENTS

| | | | |
|---|---|---|---|
| 571,681 | 11/1896 | Newell | 190/2 |
| 2,048,553 | 7/1936 | Kennedy | 190/1 |
| 3,092,233 | 6/1963 | Martin | 190/1 |
| 4,068,786 | 1/1978 | Taniguchi | 190/2 |
| 4,466,516 | 8/1984 | Sicoli et al. | 190/2 |
| 4,466,517 | 8/1984 | Spiegelman | 190/2 |
| 4,606,087 | 8/1986 | Alivizatos | 190/2 |
| 4,671,393 | 6/1987 | Rainey | 190/901 |
| 4,681,195 | 7/1987 | Trahan et al. | 190/2 |
| 4,837,590 | 6/1989 | Sprague | 190/1 |

FOREIGN PATENT DOCUMENTS

| | | | |
|---|---|---|---|
| 986147 | 7/1951 | France | 190/1 |
| 1116285 | 5/1956 | France | 190/1 |
| 2054388 | 2/1981 | United Kingdom | 190/1 |

*Primary Examiner*—Gary E. Elkins

[57] ABSTRACT

An infant care platform utilizing first and second members which are hingedly movable relative to one another. The first and second members are arranged such that the bottom portion of the first member is capable of lying at substantially the same level as a surface of the second member to form a support unit. The first and second members may also close to form a chamber. The support unit first and second members also extend relative to one another to form a larger sized platform.

5 Claims, 3 Drawing Sheets

PORTABLE INFANT CARE PLATFORM

BACKGROUND OF THE INVENTION

The present invention relates to a novel infant care platform.

It is necessary to transport certain items used in the care and feeding of infants while traveling from one place to another. For example, diapers, feeding bottles, ointment, and the like are often placed in a tote bag and carried with the infant.

When the infant is in need of attention, the parents or other persons administering the care find a suitable place for the infant to recline. For example, the infant may be placed on a bed, a carpet, a table and the like. Unfortunately, such surface is not often readily available, requiring that the parents seek such a place before utilizing the care implements found in the tote bag.

An infant care platform which is portable and also serves as a carrier for infant care implements would be a notable advance in the field of convenience articles.

SUMMARY OF THE INVENTION

In accordance with the present invention a novel and useful portable infant care platform mechanism is herein provided.

The infant care platform mechanism of the present invention utilizes a first member having a bottom portion and wall portions extending therefrom. The first member is rotatably movable relative to a second member such that the bottom portion of the first member is capable of lying at substantially the same level as a surface of the second member to form a support unit. The support unit may include a headrest placed atop the bottom portion of the first member or the surface of the second member. Also, compartments may be formed on the bottom portion of the first member to hold different accessories used in infant care. Such compartments may be accessible from the outside of the second member. In this regard, the first and second member may also close relative to one another to form a chamber containing at least one compartment formed on the bottom portion of the first member.

Further, the portable infant care platform of the present invention may include means for extending a dimension of the support unit when the first and second members are opened to form such support unit. Such extension may include the provision of a third member interposed the first and second members. The third member may be slidably connected to the second member and also include a surface which lies immediately adjacent the surface of the second member. The first member may also include a flap which is hingedly attached to the base portion thereof and to the third member. The sliding movement between the second and third members may be stopped or arrested as desired to predetermine the degree of the extension of the support unit comensurate with the size of the infant being attended to thereupon.

It may be apparent that a novel and useful infant care platform has been described.

It is therefore an object of the present invention to provide an infant care platform which is portable and serves as a substitute for a tote bag containing infant care accessories.

It is another object of the present invention to provide an infant care platform having movable portions which form a chamber and include compartments which are accessible from the inside or the outside of such chamber.

Yet another object of the present invention is to provide an infant care platform which includes an adjustable dimension to accommodate infants of different sizes.

A further object of the present invention is to provide an infant care platform which is compact and unobtrusive in appearance.

The invention possesses other objects and advantages especially as concerns particular characteristics and features thereof which will become apparent as the specification continues.

Figure 1:
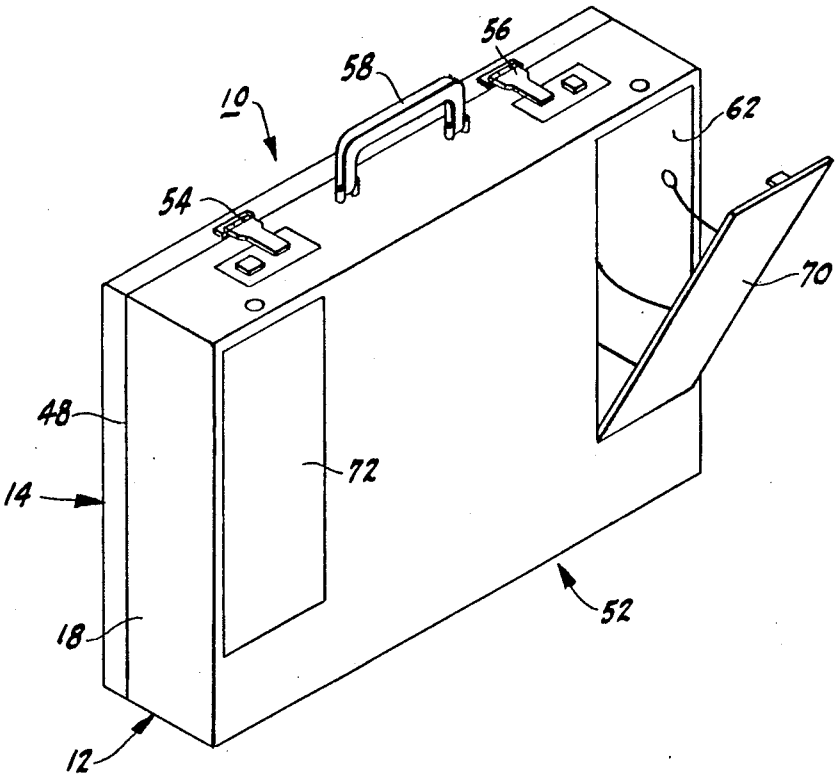
FIG. 1 is a top right perspective view of the infant care platform of the present invention in its closed position.

For a better understanding of the invention reference is made to the following detailed description of the preferred embodiments thereof which should be reference to the hereinabove described drawings.

DESCRIPTION OF THE PREFERRED EMBODIMENTS

Various aspects of the present invention will evolve from the following detailed description of the preferred embodiments thereof which should be referenced to the prior described drawings.

The invention as a whole is depicted in the drawings by reference character 10. The infant care platform mechanism 10 includes as one of its elements a first member 12 which is rotatably movable relative to a second member 14. First member 12 includes a bottom portion 16 having wall portions 18 which extend outwardly therefrom. First member 12 bottom portion 16 serves as a support for headrest 20 which may be connected to bottom portion 16 by Velcro strips 22. Bottom portion 16 also supports accoutrements 25 held to bottom portion 16 by plurality of bands 27.

Figure 2:
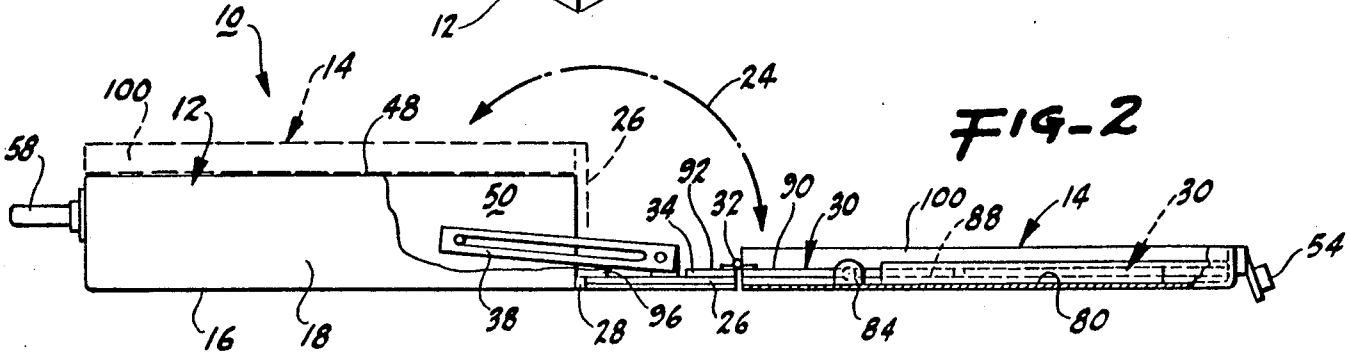
FIG. 2 is a side elevational view of the infant care platform of the present invention in its open position.
Figure 3:
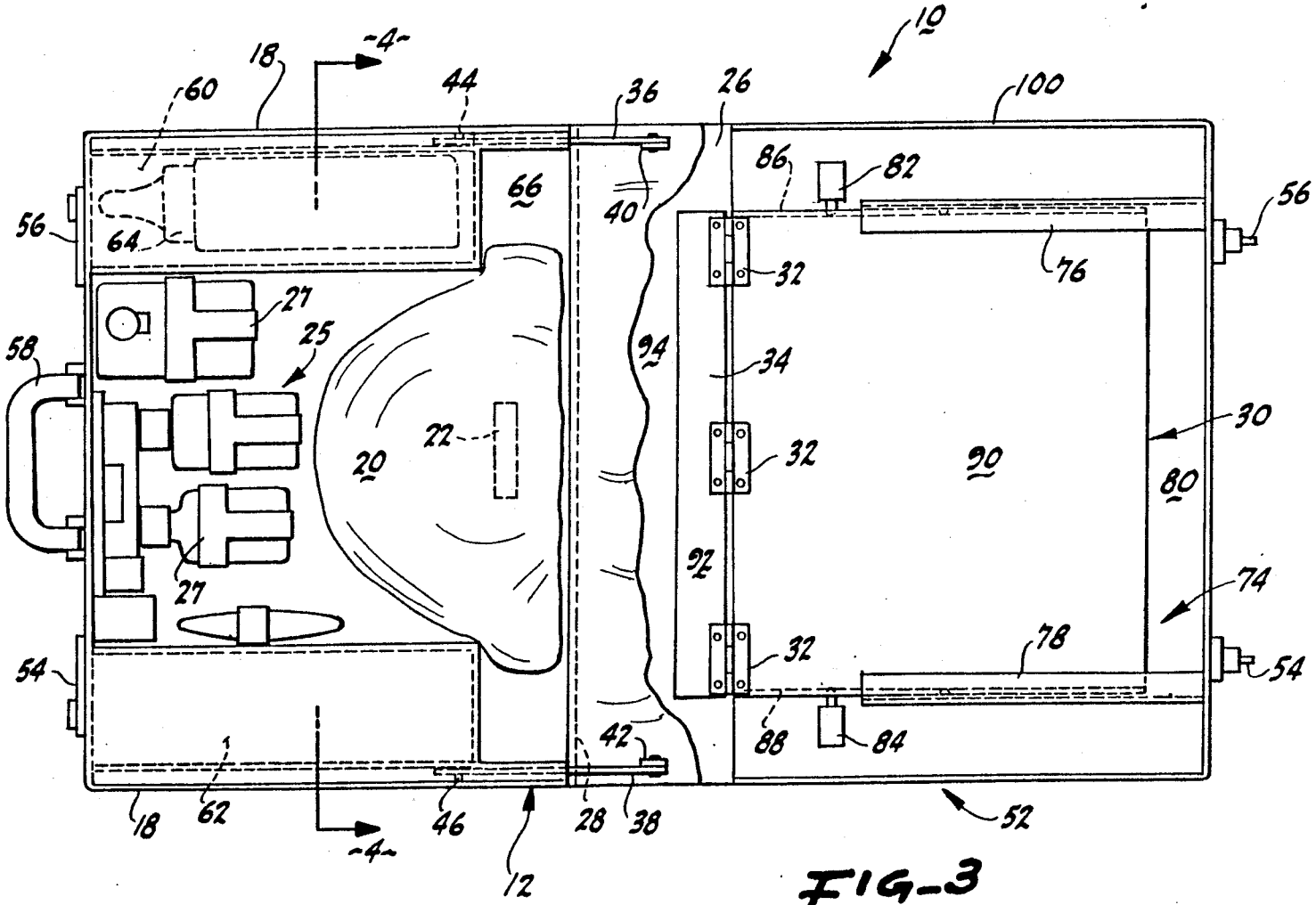
FIG. 3 is a top plan view of the opened infant care platform depicted in FIG. 2.
Figure 4:
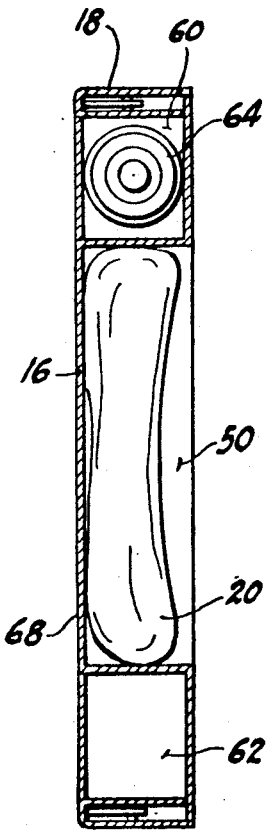
FIG. 4 is a sectional view taken along line 4—4 of FIG. 3.
Figure 5:
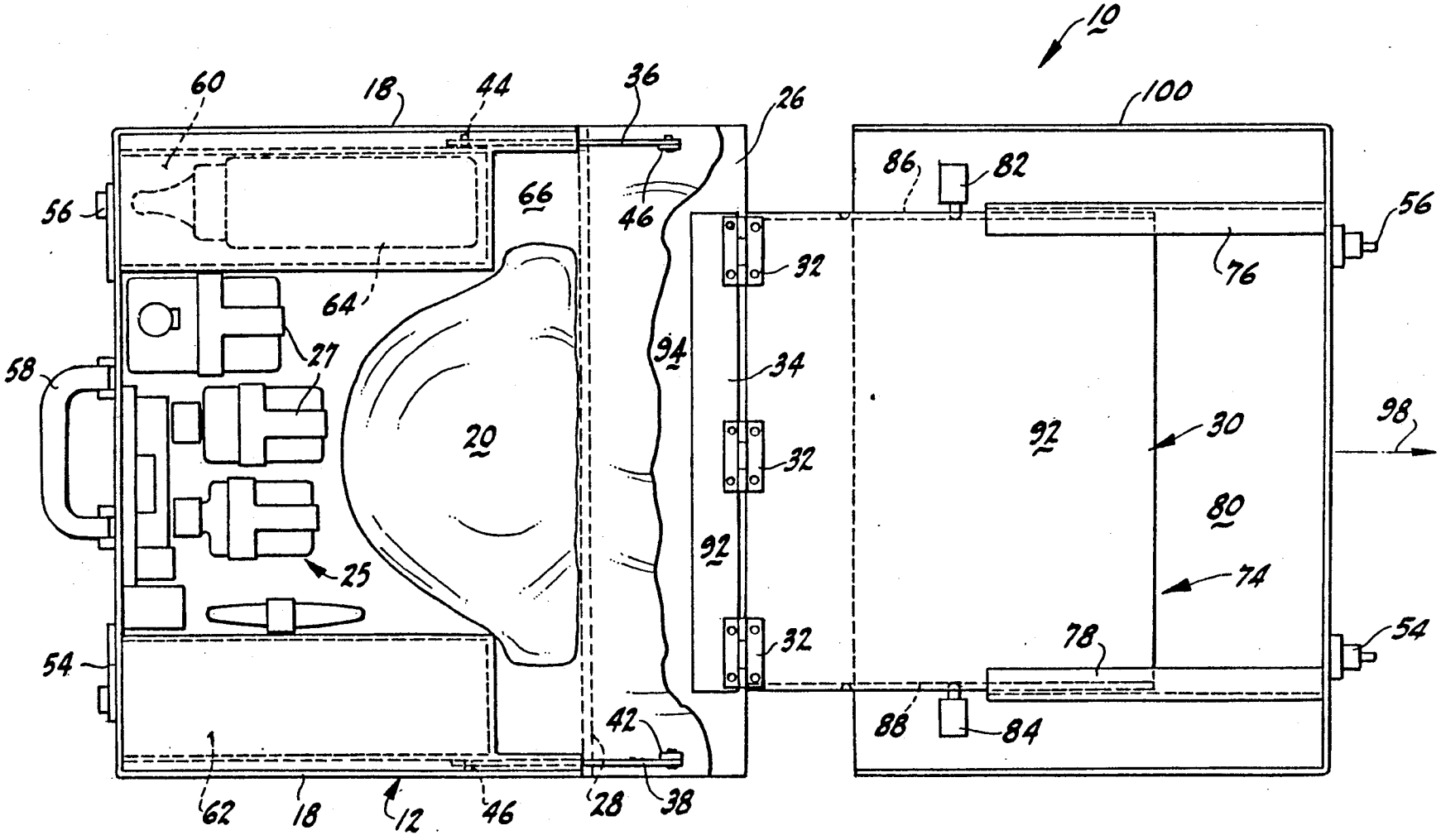
FIG. 5 is a top plan view of the infant care platform of the present invention showing the platform in its extended state from the depiction shown in FIG. 3.

First and second members 12 and 14 rotate according to directional arrow 24. In this regard, first member 12 includes a flap 26 which rotates around bar 28. Third member 30 is interposed first and second members 12 and 14. Third member 26 may be formed of any rigid or semi rigid material such as plastic glass and the like. With reference to FIGS. 2, 3 and 5, it may be apparent that third member 30 hingedly attaches to flap 26 of first member 12 via a plurality of hinges 32. Structural member 34 fixes to flap 26. Hinge guides 36 and 38 pivotally connect to posts 40 and 42 extending from flap 26. Pins 44 and 46 slide within slots afforded by the guides 36 and 38. Flap 26 and second and third members 14 and 30 rotate atop edge 48 of first member 12 to form a chamber 50 within shell or support unit 52 depicted in FIG. 1. Latches 54 and 56 secure chamber 50 within support unit 52. Handle 58 permits the user to easily carry support unit 52. Compartments 60 and 62, FIGS. 1, 4, and 5, enclose other items such as bottle 64. Compartment 60 and 62 are accessible at surface 66 of first member 12 or at outer surface 68, FIG. 1. In this regard, door 70 is depicted as swinging outwardly to permit access to compartment 62, FIG. 1. Door 72 is shown as being closed on FIG. 1 but leads into compartment 60 when open.

Means 74 is also depicted for extending a dimension of shell or support unit 52. Means 74 may take the form of providing third member 30 into sliding engagement with tracks 76 and 78, FIG. 5 which are fixed to upper surface 80 of second member 14. Indents 82 and 84 fit within grooves 86 and 88 along the edges of third member 30.

In operation, the user may open structural member 52 into the position depicted in FIG. 2 via directional arrow 24. At this point, chamber 50 is open such that upper surface 66 of first member 12 and upper surface 80 of second member 14 lie at substantially the same level. Third member 30 overlaps second member 14 to a certain degree and include a upper surface 90 which is slightly higher than surfaces 66 and 80 of first and second members 12 and 14. Moreover, structural member 34 includes a surface 92 which lies substantially at the same level as surface 90 of third member 30. The upper surface 94 of flap 26 lies slightly below upper surface 92 of structural member 34. However, padding 96 may be employed to essentially even surfaces 90, 92 and 94. An infant may then be placed on headrest 20 such that accoutrements 25 are available for use. If the overall length of shell or support unit 52 in its open position, FIG. 3 is insufficient, the user may pull members 12 and 14 apart to permit third member 30 to slide within grooves 86 and 88 to lengthen the overall dimension of shell or support unit 52. This lengthened state is shown in FIG. 5. After use in the positions depicted in FIGS. 3 or 5, the user may then reform chamber or compartment 50 by rotating connected second and third members 14 and 30 with plurality of hinges 32. Flap 26 is then rotated about bar 28. Flap 26 forms the bottom of structural unit 52. Wall portion 100 of second member 12 abuts top edge 48 of first member 12, depicted in phantom on FIG. 2. The user is then able to gain access to compartments 60 and 62 within rotating second and third members 12 and 30 relative to first member 14 by the use of external doors 70 and 72.

While in foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An infant care platform mechanism comprising;

a. a first member having a bottom portion and wall portions extending from said bottom portion;

b. a second member having a surface, said first member being capable of lying substantially the same level as said surface of said second member to form a support unit;

c. means for extending a dimension of said support unit, said means for extending a dimension of said support unit including a third member interposed between said first and second members, said third member being slidably connected to said second member said third member including a surface lying immediately adjacent said surface of said second member; and d. means for fixing said first member to said second member to form an enclosed chamber thereby including a flap hingedly attached to said first member and said flap being hingedly attached to said third member.

2. The infant care platform mechanism of claim 1 which additionally comprises a headrest placed atop said bottom portion of said first member.

3. The infant care platform mechanism of claim 1 which additionally comprises at least one compartment formed on said bottom portion of said first member.

4. The infant care platform mechanism of claim 3 in which said compartment includes a door accessible from the outside of said enclosed chamber formed by said first and second members.

5. The infant care platform mechanism of claim 4 in which additionally comprises stop means for arresting sliding movement between said second and third members.

* * * * *